United States Patent [19]

Straitz, III

[11] 4,255,120

[45] Mar. 10, 1981

[54] PORTABLE SAFETY FLARE FOR COMBUSTION OF WASTE GASES

[76] Inventor: John F. Straitz, III, c/o Combustion Unlimited Incorporated, Ste. 721, Benjamin Fox Pavilion, Jenkintown, Pa. 19046

[21] Appl. No.: 966,614

[22] Filed: Dec. 5, 1978

[51] Int. Cl.[3] ..... F23D 13/20

[52] U.S. Cl. ..... 431/202; 431/5; 431/33; 431/114; 431/154; 431/346; 169/69

[58] Field of Search ..... 431/5, 33, 202, 114, 431/346, 154; 169/69

[56] References Cited

U.S. PATENT DOCUMENTS

| | | | |
|---|---|---|---|
| 3,283,497 | 11/1966 | Kaplan | 431/202 X |
| 3,749,546 | 7/1973 | Reed et al. | 431/202 X |
| 3,756,765 | 9/1973 | Sparrow et al. | 431/202 |
| 3,782,474 | 1/1974 | Wiseman | 169/69 X |
| 3,822,983 | 7/1974 | Proctor et al. | 431/202 |
| 4,092,095 | 5/1978 | Straitz | 431/114 |
| 4,140,471 | 2/1979 | Straitz et al. | 431/5 |

*Primary Examiner*—Robert S. Ward, Jr.

*Attorney, Agent, or Firm*—Seidel, Gonda, Goldhammer & Panitch

[57] ABSTRACT

A portable safety flare for combustion of waste gases is disclosed for the combustion of combustible gas from oil wells, combustible waste gas from oil refineries and chemical plants, and particularly where it is not desired to go to the expense of installing a flare stack or for use in exploratory operations close to residential areas, or where the flare stack is not functional so that shut-down of the refinery would be required until the flare stack is repaired, and which preferably includes a vehicular trailer body with a floor and having stabilizing supports and side walls movable from closed positions for transport to elevated and heat shielding positions for use, and with provisions for noise suppression, the floor having waste gas burners thereabove with pilots and ignitors for staged combustion of the gas, the floor and walls being protected against the heat generated by the combustion, the trailer having sources of pressure fluid for operating various components and a source of igniting gas, and a motor driven tractor, separable from the trailer, the tractor having a control panel with pilot controls, staging control with manual override, and other controls.

24 Claims, 16 Drawing Figures

PORTABLE SAFETY FLARE FOR COMBUSTION OF WASTE GASES

CROSS REFERENCE TO RELATED APPLICATIONS

This invention is generally similar to but has a somewhat different field of use than that shown in my prior application for letters patent for Portable Safety Flare, filed July 27, 1978, Ser. No. 928,355, now abandoned.

BACKGROUND OF THE INVENTION

1. Field of the Invention

This invention relates to portable safety flares for the combustion of combustible gas from oil wells, waste combustible gas from oil refineries and the like and more particularly to a portable safety flare for emergency use, which can be utilized as temporary equipment to keep down expense.

2. Description of the Prior Art

It has heretofore been proposed to dispose of waste combustible gas by burning the gas at the top of a fixedly mounted flare stack which may be of a height of one hundred and fifty feet or higher.

It has also been proposed to employ flare pits, built into the ground, for disposing of waste combustible gas.

It has also been proposed to employ burners on fixed offshore platforms for disposal of combustible gas.

Permanent installations of the character referred to above do not satisfy the requirements for a portable flare which can be used in lieu of or prior to completion of the permanent installation or where infrequent use does not justify a permanent installation, or where exposed burning of waste gas would be inconsistent with local environmental demands, or in the event of an accident to a flare stack or flare burner which renders it unavailable for use so that shut down of other equipment would be necessitated.

SUMMARY OF THE INVENTION

In accordance with the invention a portable safety flare is provided for combustion of gas from oil wells prior to construction or in lieu of flare stacks, for combustion of waste combustible gas from oil refineries and the like in the event of failure of existing flare stacks, and which includes a vehicular trailer body with a floor and stabilizing supports and having side walls movable from closed positions for transport to elevated and heat shielding positions for use, with provisions for staged combustion and noise suppression, the floor and walls being protected against the heat generated by the combustion, the trailer having sources of pressure fluid for operating various components and a source of igniting gas, and a motor driven tractor separable from the trailer with an interconnecting heat resistant or shielded cable, the tractor having a control panel with pilot controls, staging controls with manual override, and other controls.

It is the principal object of the invention to provide a portable safety flare which will be essentially self-sustaining for combustion of waste combustible gas.

It is a further object of the invention to provide a portable safety flare having protective features contributing to safe operation and reduction of hazards to nearby objects and personnel.

It is a further object of the invention to provide a portable safety flare which has side wall portions movable to closed and protective positions for transport and movable to open positions for use, auxiliary equipment being provided to raise and lower side wall portions and retain the same in elevated position.

It is a further object of the invention to provide a portable safety flare in which the side wall portions in closed positions for transport protect the interior of the combustion space.

It is a further object of the invention to provide a portable safety flare for staged combustion to accommodate various waste gas flows.

It is a further object of the invention to provide a portable safety flare having as components a separable motor driven tractor and trailer and in which the tractor can serve as a control station.

It is a further object of the invention to provide a portable safety flare having as components a separable motor driven tractor and trailer and in which the trailer serves as the location for combustion of waste combustible gases.

It is a further object of the invention to provide a portable safety flare having a trailer which serves as the location for combustion of waste combustible gases and in which the trailer bed or deck, its wheels and its supports are shielded from the heat of combustion.

It is a further object of the invention to provide a portable safety flare which is suitable for burning waste combustible gas, in which a trailer serves as the location for combustion, and in which the trailer is stabilized to prevent overturning by wind effective thereon.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, and more specifically to FIGS. 1, 2, 3, 4 and 14, a motor operated tractor 25 (see FIG. 14) is provided for separable connection to a trailer 26 (see FIGS. 1, 2, 3, and 4).

Figure 14:
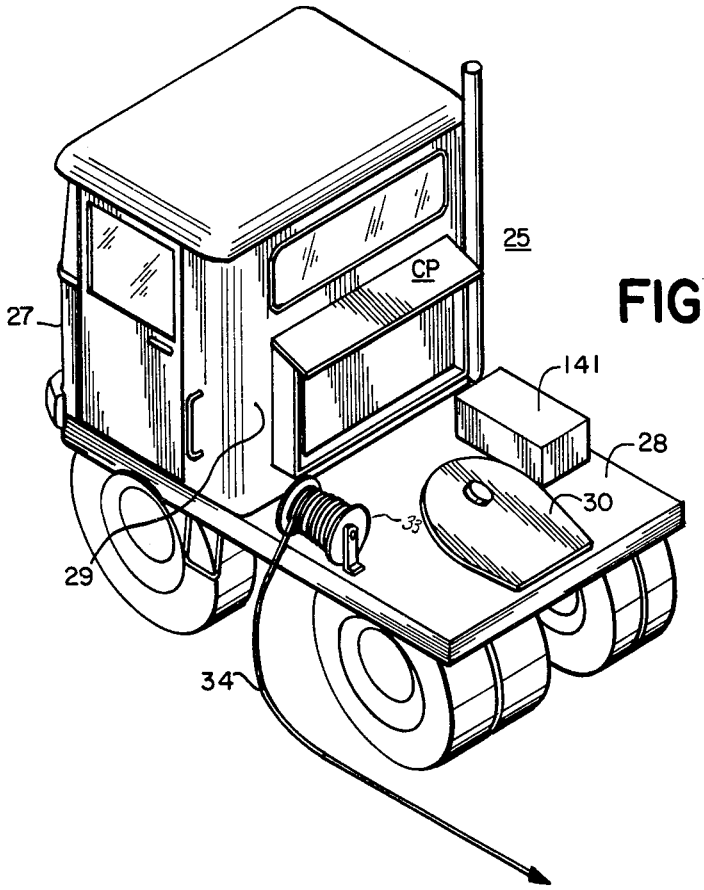
FIG. 14 is a view in perspective of the tractor separated from the trailer.

The tractor 25, as shown in FIG. 14, can be of conventional type with a cab 27 having a floor 28, a rear cab wall 29, and a fifth wheel 30 for driving connection in a well known manner to the trailer 26.

The rear cab wall 29 preferably carries a control panel CP and the tractor 25 can also be provided with a cable drum 33 for the reception of a cable 34 carrying the conductors which extend between the tractor 25 and the trailer 26 when the tractor 25 and trailer 26 are widely separated during use of the trailer 26 as a burner.

The trailer 26 (see FIGS. 1, 2, 3 and 4) can be of a size as determined by the expected quantity of waste material to be burned or as one of a plurality of units where very large quantities of gas are to be burned. In a specific embodiment one of the trailers 26 has a bed or floor 35 of the order of eight feet wide and forty five feet long, to meet motor vehicle regulations.

The trailer 26 has a plurality of supporting wheels 36 and a front prop 37 for support of the trailer 26 when the tractor 25 is separated therefrom. In order to stabilize the bed 35 when the same is in use, front and rear supports 38 are provided, on each side.

The supports 38 are normally, in their retracted positions, disposed beneath the bed 35 (see FIGS. 1 and 4) but in their operating positions are swung outwardly at right angles to the bed 35 (see FIGS. 2 and 3) and their supporting feet 39 moved downwardly into engagement with the ground. The manner of effecting this is pointed out below.

The bed or floor 35 carries and supports a transverse header 40 with a flanged fluid inlet connection 41 for connection of a supply pipe (not shown) for delivery of the combustible waste gas to be burned.

A plurality of longitudinal headers 42 are provided, connected to and extending from the header 40 to the rear of the trailer 26. The headers 42 may be retained in place in any desired manner (see FIGS. 2 and 4) such as by loosely fitted supporting saddles 43 which permit of longitudinal expansion and contraction of the headers 42. The headers 42 have drain valves 44 at their rear ends for draining of liquid from the headers 42.

The trailer bed 35 has a plurality of enclosing walls for a combustion space which includes a vertical front wall 45, a vertical rear wall 46 and vertical side walls 47.

The front and rear walls 45 and 46 and each of the side walls 47 preferably has a plurality of outer metallic panels 48, with an insulating lining 48*a* of heat resistant ceramic fiber blanketing, of a thickness of about three inches and with an interior protective spray coating 48*b* of water glass solution to rigidize the blankets 48*a* to prevent erosion of or damage to the insulating lining 48*a*.

One suitable lining material is available under the name of KAOWOOL from Babcock & Wilcox Company, New York, New York, and consists of stable high temperature alumina silica ceramic fibrous sheets.

The side wall panels 48, at their lower ends have vertical stiffening braces 52.

The braces 52 serve to support a plurality of horizontally slidable wind fences 53 with upper box beam sockets 54 for the reception of horizontally slidable guides 55 connected to metallic plate front walls 56 of the fences 53, and with metallic plate bottom walls 57 extending horizontally from the front walls 56 and supported by angles 58 slidably carried on angles 59 on the braces 52.

The front wall plates 56 and bottom wall plates 57 preferably have insulating linings 56*a* and 57*a* similar to the lining 48*a*, and interior protective stainless steel perforated sheets 56*b* and 57*b*. In order to retain the wind fences 53 in their inner positions during transport rotatable locks 60 such turn buttons, are provided on the bed 35 and engaging the wind fences 53. In a specific embodiment the overall height of the trailer 26 including the wind fences 53 and side walls 47 will be of the order of 12 feet to meet motor vehicle regulations.

Each of the walls 45, 46 and 47 has hingedly secured thereto, such as by hinges 63, upper wall panels 64 with high temperature resistant stainless steel alloy brackets 65 on opposite walls 45, 46 and 47 for supporting the panels 64 in horizontal positions. The wall panels 64 have eyes 66 for raising them to vertical positions for use and for lowering them to their horizontal positions.

The panels 64 have flanges 67 to overlap adjoining panels 64 when raised to prevent undesired heat radiation outwardly between the panels and to protect the interior when the panels 64 are lowered.

The panels 64 have linings of fibrous ceramic refractory material and a protective spray coating of water glass solution to rigidize the fibrous ceramic liners similar to the wall panels 48.

In order to accommodate the panels 64 in lowered positions the wall panels 48 are preferably of successively reduced height from front to rear.

The panels 64 are retained in upright position in any desired manner such as by bolts 70 slidably and rotatably carried in sockets 71 on the walls 45, 46 and 47 movable into sockets 72 on the panels 64. The bolts 70 can have projections 73 engageable in spaced retainers 74 in raised or lowered positions.

Figure 16:
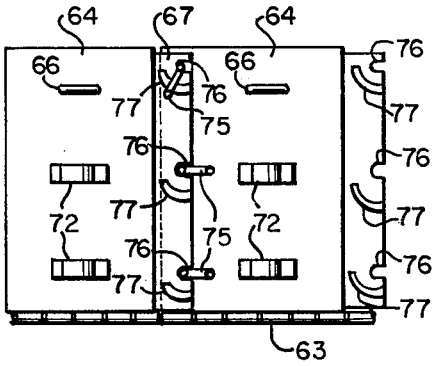
FIG. 16 is an enlarged fragmentary view in elevation showing locking means for elevated wall panels.

Additional locking members can also be provided for locking the flanges 67 to adjoining panels 64 and which comprise rotatable arms 75 extending through slots 76 in the flange 67 engageable with wedges 77 on the flanges 67 (see FIG. 16).

The panels 64 can be raised or lowered in any desired manner but it is preferred that a trolley 80 be employed carried on upper and lower tracks 81 and 82 carried on the outside of the front, rear and side walls 45, 46 and 47. The trolley 80 has fluid motor driven wheels 83 and 83*a* engaging the upper track 81, and driven by fluid motor 79, wheel 84 engaging the lower track 82 and flexible or pivotally connected outriggers 85 with wheels 86 engaging the upper track 81.

The trolley 80 has rotatable crane support 89 which carries a pivotally mounted crane arm 90. The crane arm 90 is positioned by a hydraulic cylinder and piston 91 controlling a positioning arm 92.

The crane arm 90 carries a cable 93 with a hook 94 for engagement with an eye 66 on a panel 64, the cable 93 being controlled by a reversible motor driven winch 92*a*.

Figure 1:
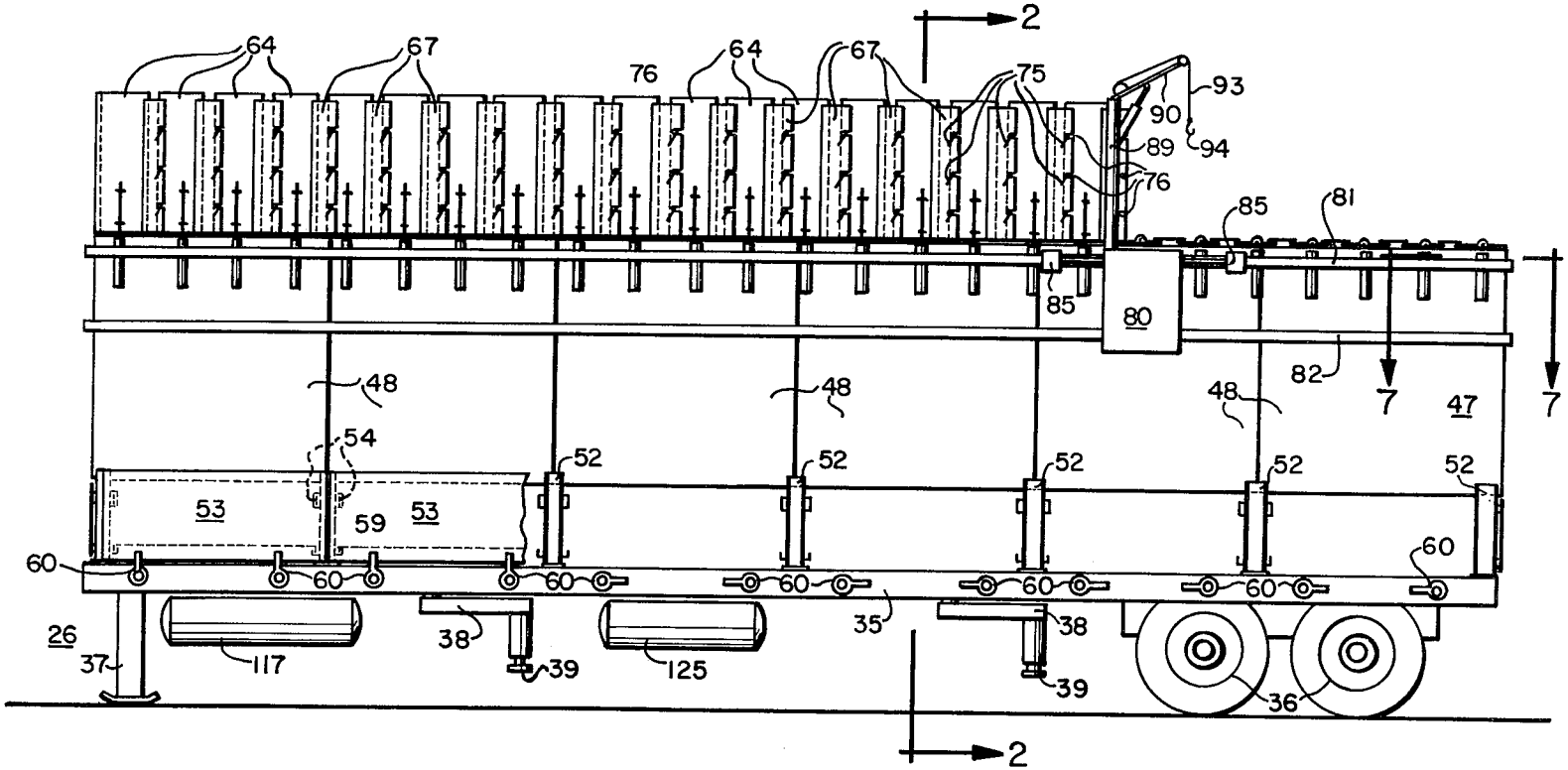
FIG. 1 is a side elevational view of the trailer employed in connection with the invention, part of the movable side wall panels being in an upright position for use.
Figure 2:
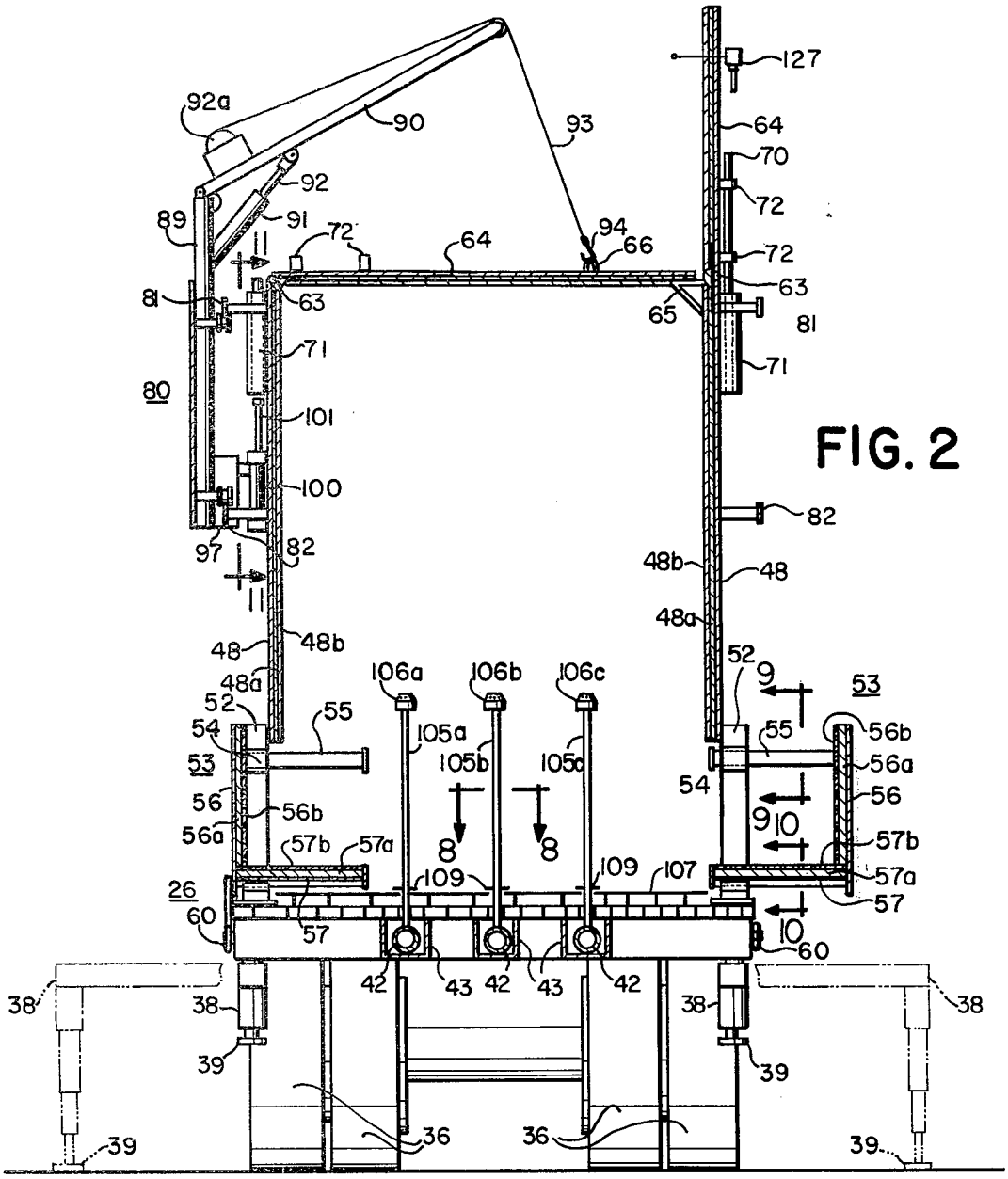
FIG. 2 is a vertical transverse sectional view, enlarged, taken approximately on the line 2—2 of FIG. 1.
Figure 11:
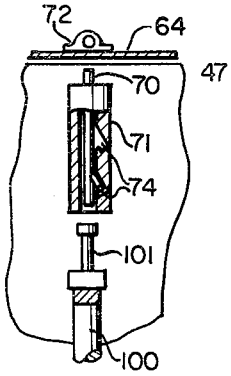
FIG. 11 is a fragmentary vertical sectional view, enlarged, taken approximately on the line 11—11 of FIG. 2.
Figure 9:
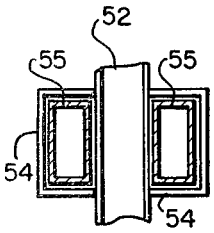
FIG. 9 is a fragamentary vertical sectional view, enlarged, taken approximately on the line 9—9 of FIG. 2.
Figure 10:
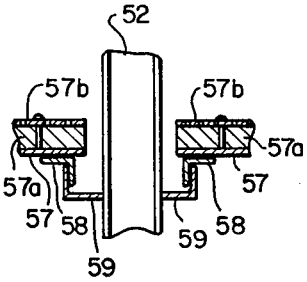
FIG. 10 is a fragmentary vertical sectional view, enlarged, taken approximately on the line 10—10 of FIG. 2.
Figure 8:
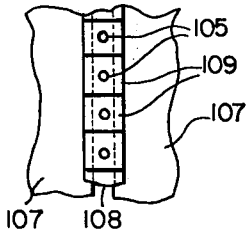
FIG. 8 is a fragmentary horizontal sectional view taken approximately on the line 8—8 of FIG. 2.
Figure 3:
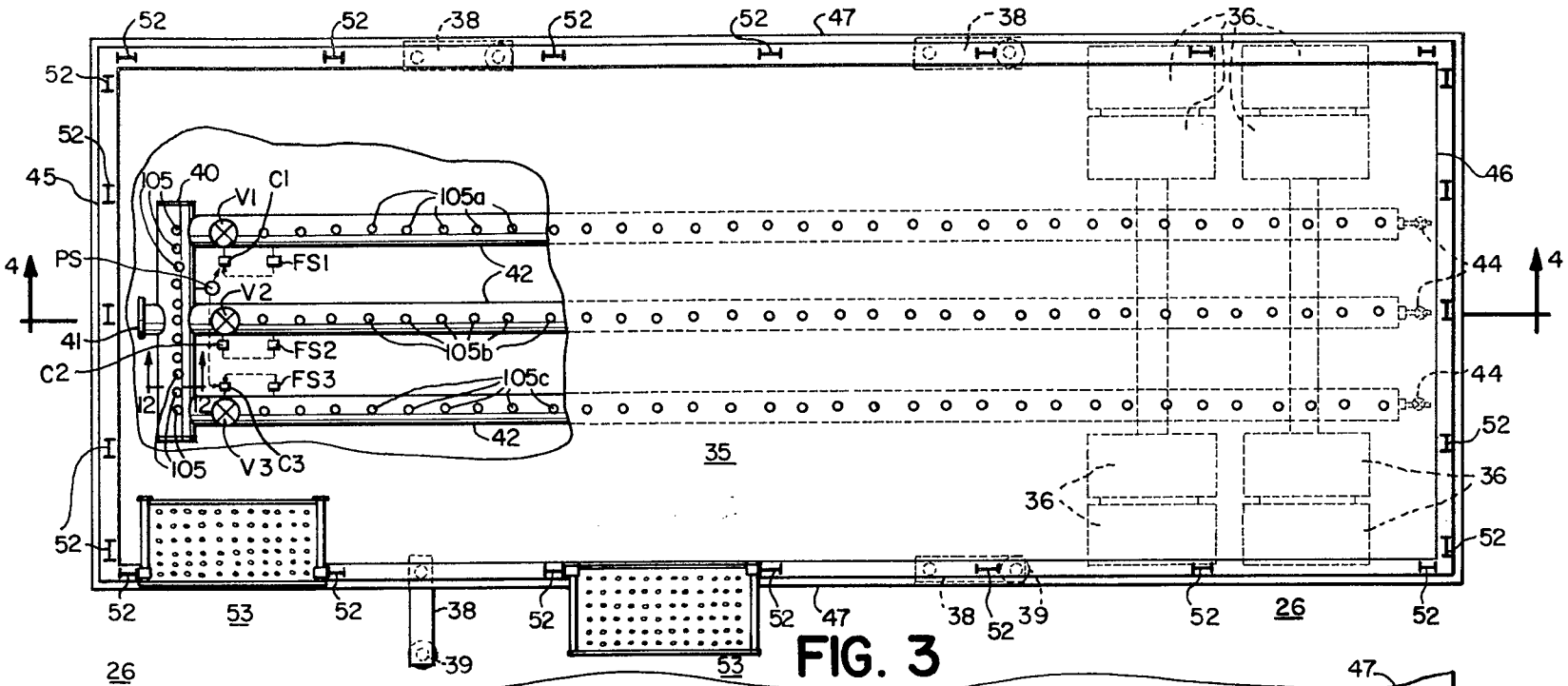
FIG. 3 is a fragmentary top plan view of the trailer shown in FIGS. 1 and 2, parts being broken away to show the details of the headers.
Figure 4:
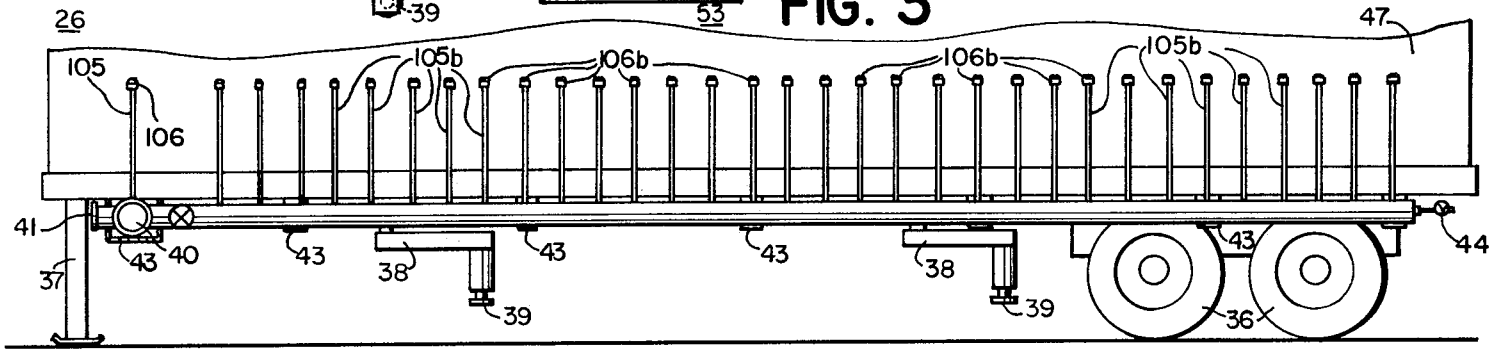
FIG. 4 is a longitudinal vertical sectional view, taken approximately on the line 4—4 of FIG. 3.
Figure 5:
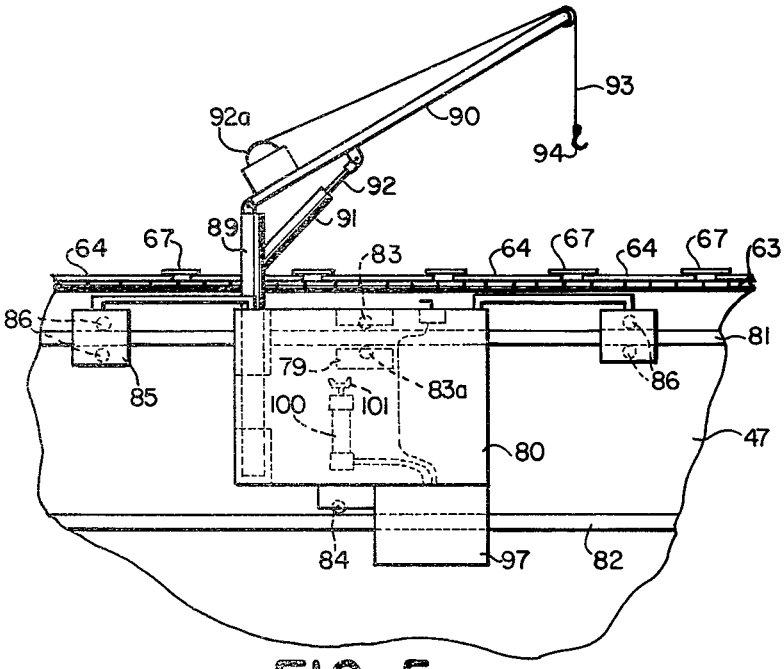
FIG. 5 is a fragmentary view in elevation, enlarged, showing the mechanism, including the trolley, for raising and lowering side wall panel portions.
Figure 7:
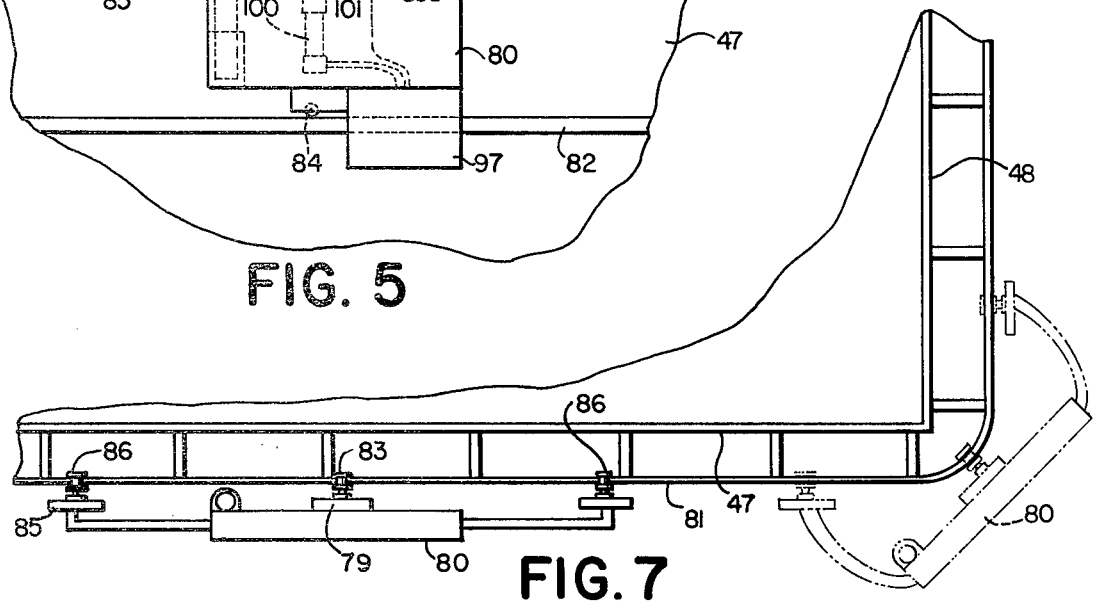
FIG. 7 is a fragmentary horizontal sectional view, enlarged, taken approximately on the line 7—7 of FIG. 1, and illustrating a portion of the trackway for the trolley.
Figure 6:
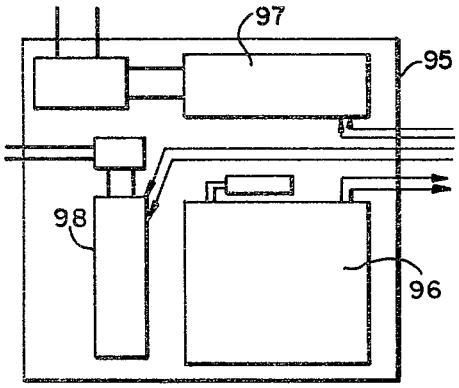
FIG. 6 is a diagrammatic view showing the controls for the trolley.

The trolley 80 is preferably provided with its own power units in a housing 95 (see FIG. 6) and which includes a gasoline engine driven generator 96 to operate a reversible electric motor and pump 97 for supply and return of hydraulic fluid for the cylinder 91, and a reversible electric motor and pump 98 for supply and return of fluid to the fluid motor 79.

In order to position the bolts 70 a hydraulic cylinder 100 may be provided in the housing 95 to actuate a bolt operating rod 101.

The trailer bed or floor 35, as previously pointed out, carries the transverse header 40 and the longitudinal headers 42 (see FIGS. 1, 2, 3, 8, 12 and 13).

In order to burn the waste gas a first stage is provided, the header 40 having a plurality of vertical stainless steel pipes 105 of one inch diameter on one foot centers, extending about three feet above the bed 35, with burner heads 106, also of stainless steel, at their upper ends. The burner heads 106 can be of any desired type those shown in U.S. Pat. No. 3,463,602 to Bitterlich et al. being suitable.

In order to protect the trailer bed or floor 35 a heat resistant floor is provided of spaced plates 107 of stainless steel, about two feet by five feet, spaced upwardly from the trailer bed 35 about six inches, the pipes 105 extending upwardly in the openings 108 between the plates 107, the openings being about three inches. Each of the pipes 105 has a covering plate 109, preferably of stainless steel about three inches wide and one foot long, welded thereto and spaced above the plates 107 and in overlapping relation and spaced above the opening 108 about two inches to provide a free floating floor construction not subject to buckling.

In order to ignite gas at the burner tips 106 of the first stage (see FIG. 12) a pilot nozzle 115 is provided, having a fluid connection 116 to a tank 117 mounted on the trailer 25 of pilot gas, such as propane. The supply of gas is controlled by a solenoid operated valve 118 controlled as hereinafter pointed out and with an venturi 119 for admixture of air with the pilot gas to provide the proper flame.

The gas-air mixture supplied to the pilot nozzle 115 is ignited by a spark plug 120 energized as hereinafter pointed out. A thermocouple 121 is mounted at the pilot nozzle 115 for indicating the prevailing conditions at the pilot nozzle 115.

Additional stages for combustion to correspond to the supply of waste gas are preferably provided, and for this purpose each of the manifolds 42 is provided with vertical pipes 105*a*, 105*b* and 105*c* having burner heads 106*a*, 106*b* and 106*c* above a floating floor construction as previously described.

Figure 13:
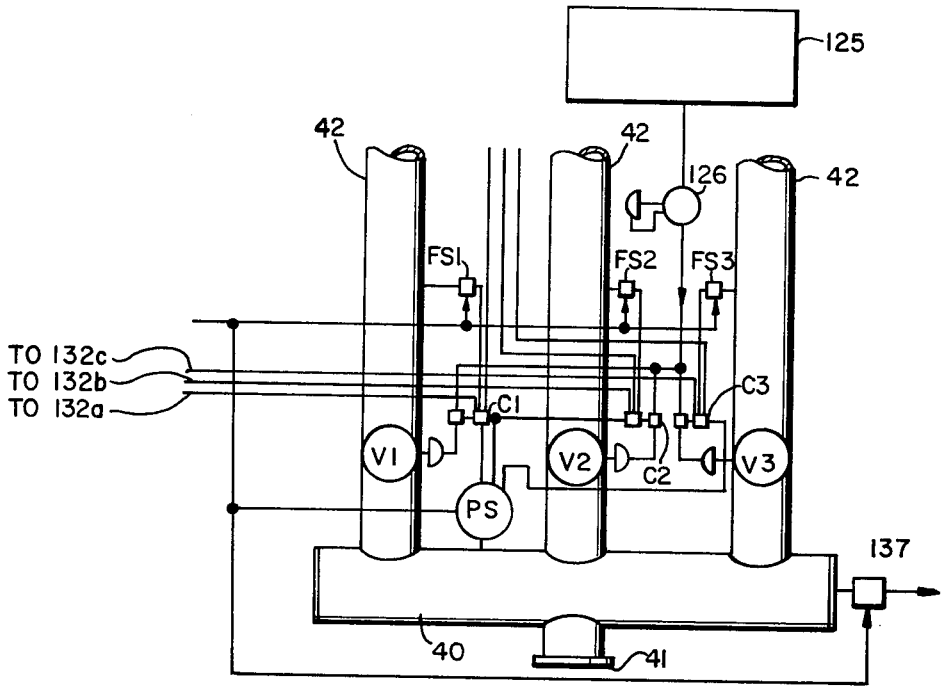
FIG. 13 is a view, partly diagrammatic, showing the staging controls.
Figure 12:
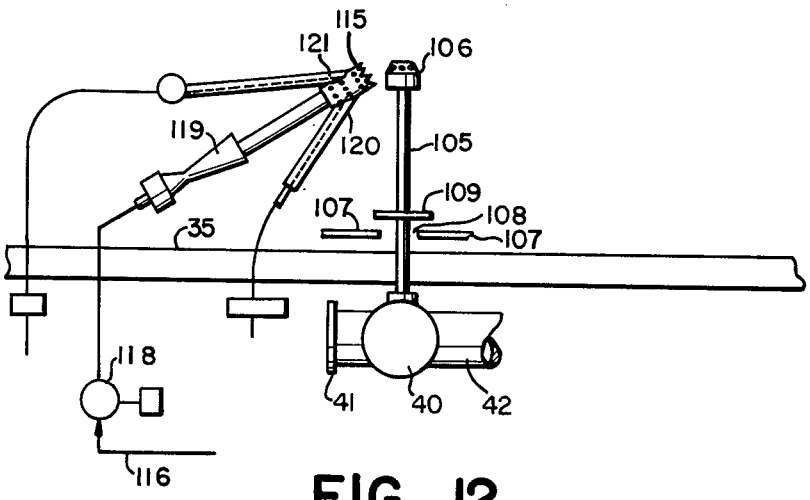
FIG. 12 is a fragmentary vertical sectional view, enlarged, taken approximately on the line 12—12 of FIG. 3.

Referring to FIG. 13, a pressure responsive switch PS is provided, connected to the manifold 40, for actuation of controllers C1, C2 and C3 for valves V1, V2 and V3. The pressure switch PS preferably has three independent switch points set to act at desired pressure levels in the header 40.

In order to provide actuating fluid for the staging control a tank 125 of liquid nitrogen is provided, mounted below the floor 35 and connected through a pressure regulator valve 126, to each of the controllers C1, C2 and C3, as shown in FIG. 13.

Each manifold 42 has a flow switch FS1, FS2 or FS3 connected thereto for providing a signal to the respective controller C1, C2 and C3 in the event of cut off of flow, to shut the respective valves V1, V2 and V3.

Figure 15:
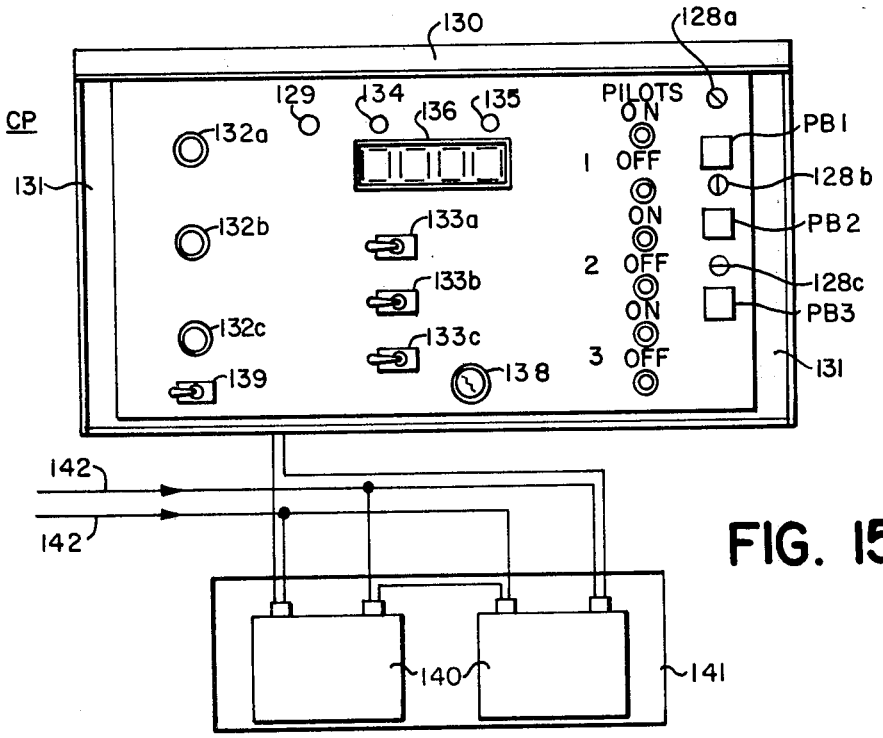
FIG. 15 is a view, partly diagrammatic, of the control panel on the tractor.

Referring now to FIGS. 13 and 15, the control for the valves V1, V2 and V3 is shown in connection with the control panel CP.

The control panel CP preferably has a rain hood 130 and side shields 131. Each of the pilots through its thermocouple 121 preferably provides a signal for activation of "ON" or "OFF" signal lamps Nos. 1, 2 and 3 together with pilot on-off switches 128*a*, 128*b*, 128*c* and pushbutton switches PB1, PB2 and PB3 to activate the respective spark plugs 120.

The control panel CP also has indicator lights 132*a*, 132*b*, 132*c*, as to the stages which are in action at the respective manifolds 42. Automatic staging control override is available through manually operable on-off switches 133*a*, 133*b*, 133*c*.

Pushbuttons 134 and 135 can be utilized to obtain digital readings at the indicator 136 of the pressure and temperature at the sensor 137 on the manifold 40.

An outlet thermocouple 127 (see FIG. 2) is provided on one of the panels 64 to give an indication of outlet temperature through pushbutton 129 and digital display 136 (FIG. 15).

The control panel CP can also be provided with a key switch 138 for main power control and a control switch 139 for the supports 38.

The electric power for the control panel CP can be supplied from a power source (FIG. 15) which includes storage batteries 140 in a battery box 141 connected by power leads 142 to the tractor generator (not shown).

The mode of operation will now be pointed out.

The tractor 25 and trailer 26 are moved to the location where the waste combustible gas is to be burned, and if required a plurality of trailers 26 can be employed. The trailer 26 is preferably located in a clear area away from tall buildings or structures where the hot gas products of combustion plume could adversely affect them.

The tractor 25 and trailer 26 are separated and the tractor 25 moved to a safe distance with the cable 34 connecting the tractor 25 and trailer 26 for controlling the operation at the trailer 26 from the tractor 25 and making indications of operating conditions available at the control panel CP on the tractor 25.

The swingable supports 38 are swung outwardly and their supporting feet 39 moved into engagement with the ground to stabilize the trailer 26 against wind. The upper side wall panels 64 are raised, using the trolley 80 for this purpose and locked in their upright positions.

The acoustical wind fences 53 are unlocked and moved outwardly to their operating positions.

The waste gas supply connection (not shown) is connected to the flanged inlet connection 41. Waste gas is supplied to the transverse header 40, propane gas is supplied to the pilot burners 115 and ignited by the spark plug 120 to ignite the waste gas at the first stage burner heads 106.

If the pressure of the waste gas is sufficient, one or more additional stages will be activated through the pressure switch PS, and the controllers C1, C2 and/or C3 and valves V1, V2 and/or V3 for delivery of waste combustible gas through the burner heads 106*a*, 106*b* and/or 106*c* dependent upon the quantity of waste gas delivered, as determined by the pressure in the transverse header 40.

If the gas flow decreases as measured by the flow switches FS1, FS2 and/or FS3, one or more of the stages will be cut off.

Manual override of the action of the flow switches FS1, FS2 and/or FS3, if the need is indicated at the control panel CP, is available by utilization of the switches 133*a*, 133*b*, 133*c*.

It will be noted that the parts exposed to radiant heat are constructed of heat resistant material and that provisions have been made for noise reduction.

Upon completion of the burning the equipment can be restored to condition for transport to another location for use after replenishment of the pilot gas and the nitrogen for valve operation.

I claim:

1. A portable safety flare for waste combustible gases comprising a movable vehicle having a bed and a connection for the delivery thereto of waste gas for combustion, a plurality of header members on said bed for discharge of waste gas supplied through said connection for combustion in a combustion space, said bed having front, rear and side walls extending upwardly therefrom in surrounding relation to the combustion space, and wall panels carried by said walls and movable to upright positions.

2. The combination defined in claim 1 in which movable wind fence members are provided in certain of said walls.

3. The combination defined in claim 2 in which said wind fence members are movable with respect to said walls to positions for admission of air to said combustion space.

4. The combination defined in claim 1 in which said walls and said wall panels have protective heat resistant linings.

5. The combination defined in claim 4 in which said linings have noise reducing characteristics.

6. The combination defined in claim 3 in which said wind fence members have heat resistant and noise absorbing linings.

7. The combination defined in claim 3 in which said wind fence members are slidably movable outwardly to positions for admission of air to said combustion space.

8. The combination defined in claim 3 in which retaining members are provided for retaining said wind fence members in out of action positions for transport.

9. The combination defined in claim 1 in which elevating means is provided for said wall panels.

10. The combination defined in claim 9 in which said elevating means comprises a trolley member movable along said walls.

11. The combination defined in claim 10 in which said trolley member is provided with a crane for elevating said wall panels.

12. The combination defined in claim 10 in which means is provided for actuating said trolley member along said walls.

13. The combination defined in claim 11 in which means is provided for actuating said crane.

14. The combination defined in claim 1 in which locking members are provided for retaining said wall panels in upright position.

15. The combination defined in claim 1 in which one of said header members has burner heads connected thereto to provide a combustion stage in said combustion space.

16. The combination defined in claim 15 in which another of said header members has burner heads connected thereto to provide an additional combustion stage, and control means is provided for bringing said additional combustion stage into action.

17. The combination defined in claim 16 in which another of said headers has burner heads connected thereto for providing an additional combustion stage, and control means is provided for bringing said additional combustion stage into action.

18. The combination defined in claim 15 in which pilot means is provided for igniting the gas at said burner heads.

19. The combination defined in claim 1 in which a tractor is provided for movement of said trailer to a desired location for use.

20. The combination defined in claim 19 in which a control panel is provided on said tractor having members for initiating ignition of combustible gas discharged from said headers.

21. The combination defined in claim 19 in which a control panel is provided on said trailer having members for indicating the combustion conditions at said header members.

22. The combination defined in claim 16 in which a control panel is provided on said tractor having members for overriding said control means.

23. The combination defined in claim 18 in which a supply of pilot gas is provided on said trailer.

24. The combination defined in claim 16 in which flow control means is provided in said other of said header members for shut-off of gas supply to said header at a predetermined flow level.

* * * * *